US008205373B1

(12) United States Patent
Ubl et al.

(10) Patent No.: US 8,205,373 B1
(45) Date of Patent: Jun. 26, 2012

(54) RIMFIRE ACTION PLATFORM CONVERSION

(75) Inventors: Tim Ubl, Hutchinson, MN (US); Jarmo Kumpula, Minnetrista, MN (US)

(73) Assignee: Nordic Components, Hutchinson, MN (US)

( * ) Notice: Subject to any disclaimer, the term of this patent is extended or adjusted under 35 U.S.C. 154(b) by 624 days.

(21) Appl. No.: 12/330,409

(22) Filed: Dec. 8, 2008

(51) Int. Cl.
*F41A 21/00* (2006.01)

(52) U.S. Cl. ..... 42/71.01; 42/75.02; 42/75.03; 42/75.01

(58) Field of Classification Search ..... 42/75.01, 42/75.02, 75.03, 71.01
See application file for complete search history.

(56) References Cited

U.S. PATENT DOCUMENTS 3,611,607 A * 10/1971 Donnell ..... 42/106
4,845,871 A * 7/1989 Swan ..... 42/127
6,874,267 B2 * 4/2005 Fitzpatrick et al. ..... 42/72
7,481,016 B2 * 1/2009 Gonzalez ..... 42/127
7,574,951 B2 * 8/2009 Calvete Zumalde ..... 89/24
7,802,392 B2 * 9/2010 Peterson et al. ..... 42/75.03
7,913,439 B2 * 3/2011 Whaley ..... 42/90
2007/0017139 A1 * 1/2007 Larue ..... 42/75.1

OTHER PUBLICATIONS

Printout of website article found at: http://www.tapco.com/HTML/Instructions/10-22%20Stock%20Installation.pdf.

* cited by examiner

*Primary Examiner* — Michael Carone
*Assistant Examiner* — Daniel Troy
(74) *Attorney, Agent, or Firm* — Dwayne E. Rogge; Schacht Law Office, Inc.

(57) ABSTRACT

A rifle conversion platform assembly comprised of components to fit around an existing action such that attachment locations such as a hand guard, pistol grip, and butt stock attachment locations are provided to have conventional rifle components, which in one form may be components of a high caliber semiautomatic rifle such as an AR-15, attached thereto.

12 Claims, 16 Drawing Sheets

RIMFIRE ACTION PLATFORM CONVERSION

BACKGROUND OF THE DISCLOSURE

Firearms training, and more specifically rifle training, is a key element for supreme rifle craft. Training is an essential element for proficiency in performance with any firearm, and in particular a long gun such as a rifle.

Many shooters, whether in law-enforcement, military or a competition, train with a rifle to be supremely proficient therewith and maximize the shooter's personal performance. Although dry firing with a rifle is an essential component, actual live fire, which incorporates manipulation of a trigger ("breaking the trigger" in common firearm parlance), the actual operation of an action and the feedback of a projectile, namely a bullet impacting a target is an important element of training. However, high-power rifles and particular semi-automatic rifles generally use calibers, which are expensive to shoot. Most high-power rifles utilize centerfire cartridges such as 0.223, 7.62×39, 0.308, and 0.270 to name a few of the more popular centerfire cartridges. However, the cost per round fired for a shooter can be very prohibitive when the shooter is conducting a high volume of training or ammunition expenditure is high in general.

Dry firing (firing a long gun without a live round in the chamber or in the magazine) is a popular option to train many elements of rifle craft, such as transitions, engagement, reloads, trigger mechanics, and a plethora of other elements of high-performance shooting. However, there still remains a need for actual live fire for the shooter.

For certain training elements such as shooting on the move, trigger mechanics work, target transitions and other training aspects, live fire is a critical element of productive training. For example, for training such as shooting on the move, the shooter must undergo a high volume of training to coordinate their steps with breaking the trigger. Mastering this skill can take a large amount of ammunition expenditure to become proficient. Of course, this is one example of why it is important for live fire practice.

At the time of preparation of this application, ammunition prices are rather cost-prohibitive. A common round as noted above is the Winchester 0.223 and its close derivative, the 5.56 NATO round. Although with economies of scale this particular cartridge used to be relatively reasonable to purchase in volume, through various present factors ammunition prices have nearly doubled and almost tripled. An average cost for a single 0.223 round can be anywhere between $0.35-0.60. Of course with a heavy practice regimen of for example 1000 rounds, the cost of a training session for the ammunition alone can be $350-$600.

However, the tried-and-true rimfire 0.22 long rifle has remained at a relatively steady predictable price. This extremely popular and tried-and-true round has been available in the marketplace for decades and has a solid reputation for dependability and general utility. Although other rimfire cartridges are on the market and of course can be utilized in the broader scope of the teachings of the disclosure below (along with other centerfire rounds), by far and away the 0.22 long rifle round remains an economical form of firing a round. At the time of this preparation, 0.22 long rifle is available in bricks of 550 from a cost range anywhere between $13 to $26 US. This of course provides a cost per round of about $0.02-0.04 per round (where of course the marketplace provides more costly ammunition with balance bullets, precision measured powder loads, and other features which provide more expensive 0.22 ammunition for precision shooting).

With regard to high-power rifles, a very common rifle utilized by law-enforcement, military and competitive shooting is the AR-15 platform. The AR-15 rifle system has many derivatives, such as the AR-10 which is provided in 0.308 caliber, the M-4, and a plethora of other variants. In general, the AR-15 rifle platform is somewhat modular and generally comprises a lower receiver, a trigger group in the lower receiver, an upper receiver, a hand guard, a pistol grip and a butt stock. The upper and lower receiver elements are at the central foundational structural components where the external components including the hand guard, pistol grip and the butt stock are attached thereto (namely, the pistol grip and butt stock attached to the lower receiver and the hand guard attached to the upper receiver surrounding the barrel itself). The trigger group or trigger assembly is housed within the lower receiver, where various aftermarket triggers such as triggers from JP Enterprises™ can be placed therein. Therefore, it can be appreciated that most shooters have become accustomed to the hand guard, pistol grip and butt stock. Further, a necessary attachment to their rifle is some form of an optic or sighting system. Although iron sights are still utilized in some degree, generally the trend in the firearms industry is to utilize an optic such as an Acog, EO-Tech, Elcan, and a variety of magnified objects to maximize performance of the rifle. For example, a common training system is providing an Acog attached to the upper receiver and further providing a red dot system such as a J-Point provided by JP Enterprises™ attached thereto. This specific setup allows for quick acquisition of a target with the J-Point reflect optic, and further allows better accuracy through the Acog at, for example, longer distances over 50 yards. The fundamental point is that it is very important that shooters train with the same or very similar platform as to the platform that will be used in performance.

A common 0.22 long rifle action is the Ruger® 10-22. This tried-and-true rifle system has been utilized in various derivatives for decades. The 0.22 long rifle system is relatively inexpensive and can be purchased for between $200-$350 for a complete rifle. Further, the Ruger® 10-22 has various aftermarket magazines and certain reloading components, such as the Butler Creek reloader providing quick and convenient reloading of magazines, in particular when a shooter is conducting a higher round count volume training session, say of 300 to 500 rounds. The term "10-22" for this disclosure is defined as the rifle manufactured by Rueger® at the time of invention. Similarly, the term "10-22 action" for this disclosure is defined as the action manufactured by Rueger® for the 10-22 rifle at the time of invention Therefore, there is a need in marketplace for a platform conversion for a long gun with all of the external components of a high-power rifle but yet utilize an inexpensive cartridge which in one form is a rimfire 0.22 long rifle. A further element to be considered is the accuracy of a converted rifle. Therefore, provided in one is form a system where the elements that engage the shooter, such as the butt stock, pistol grip, and hand guard and all the forces upon these components are directly transmitted to (for example) a main stock which can be attached to a Ruger® 10-22 action. As described in detail herein, having an optic mount separate from a main stock and directly attached to the Ruger® 10-22 can provide better accuracy, whereby the relationship between the optic or otherwise the sighting system and the action and barrel is a direct connection and is not to be interfered with by any forces applied to the gun by the shooter. In other words, the fewer connections between the optic and the chamber provides for a more direct desirable arrangement to enhance accuracy.

SUMMARY OF THE DISCLOSURE

Disclosed herein is a housing assembly configured to be fitted to an action of a rifle. The housing assembly in one form has a main stock, a hand guard mount and an optic mount. The optic mount is configured to be attached to an upper portion of the action. The hand guard mount has an attachment portion which is operatively configured to be attached to the main stock. The hand guard mount further has a hand guard interface region configured to have a hand guard mounted thereto.

The main stock has a pistol grip mount region and a butt stock mount region configured to have a pistol grip and a butt stock mounted respectively thereto wherein any force applied to a hand guard attached to the hand guard mount and further any force applied to a pistol grip mounted to the pistol grip mount is transferred to the main stock, which in turn transfers force directly to the action, and the optic mount is operatively connected to the main stock by way of having the action interposed therebetween.

The housing assembly has an adjustment system in one form configured to be longitudinally adjusted with respect to the stock before being attached to the action. The hand guard mount emulates a threaded attachment of an AR-15 upper assembly.

In one form the hand guard configured to be mounted to an AR-15 upper assembly can be mounted to the hand guard mount and the optic mount has a picatinny rail in the upper portion thereof. In this form the orientation of the optic mount, the pistol grip mount region, and the butt stock mount region are of a similar orientation with respect to a trigger of the action as an AR-15 and preferred base action is a Ruger® 10-22.

The hand guard attached to the hand guard mount is a tubular hand guard in one form. The main stock is configured further in one from to be first fixedly and removably attached to the action, and thereafter the hand guard mount having a surface defining a barrel passage is repositioned from a forward muzzle end of the barrel so as to have the barrel pass through the barrel passageway of the hand guard mount and the hand guard mount is thereby operatively configured to be attached to the forward attachment location of the main stock. In this form the hand guard mount is not directly attached to the optic mount.

The hand guard, pistol grip and butt stock are all only attached to the main stock in one form and the main stock is attached to the action whereby any actual force applied to the hand guard, pistol grip or butt stock is not directly transferred to the optic mount.

Further disclosed herein is a method of converting a rimfire action and barrel assembly to a different rifle platform. The method includes retrieving the barrel and action assembly comprising an action having a lower and upper region and a barrel rigidly attached thereto. The method further includes positioning a main stock to the lower region of the action and rigidly attaching the main stock to the action. Then the method includes rigidly attaching an optic mount to the action at the upper region thereof. Thereafter a hand guard mount is attached to the main stock, thereby passing the hand guard mount through the barrel where the barrel passes through a surface defining a barrel passageway in the hand guard mount. The hand guard mount further comprises a hand guard interface region.

Thereafter the method includes rigidly attaching a pistol grip to a pistol grip mount region of the main stock and further attaching a butt stock to a butt stock mount region of the main stock. Finally, the method includes attaching a hand guard to the hand guard mount at the hand guard interface region. Of course the above steps can be executed in different orders of operation. This method converts the action to an AR-15 type platform where the position of the hand guard interface region of the hand guard mount, the pistol grip mount region of the main stock, and the butt stock mount region of the main stock are all orientated with respect to one another in a position of similar dimensions to an AR-15. In one form of attaching the main stock to the action, an adjustment system is provided where the action is longitudinally positioned with respect to the main stock prior to rigidly fastening the main stock to the action. The main stock can be rigidly attached to the action by way of a threaded member extending through a first action attachment location of the main stock and engaging a female threaded portion and a first attachment location of an action. Further the main stock is not directly attached to the optic mount and is only effectively attached thereto via the action interposed therebetween. Other variations and aspects of the disclosure are enclosed herein.

DESCRIPTION OF THE PREFERRED EMBODIMENTS

Figure 1:
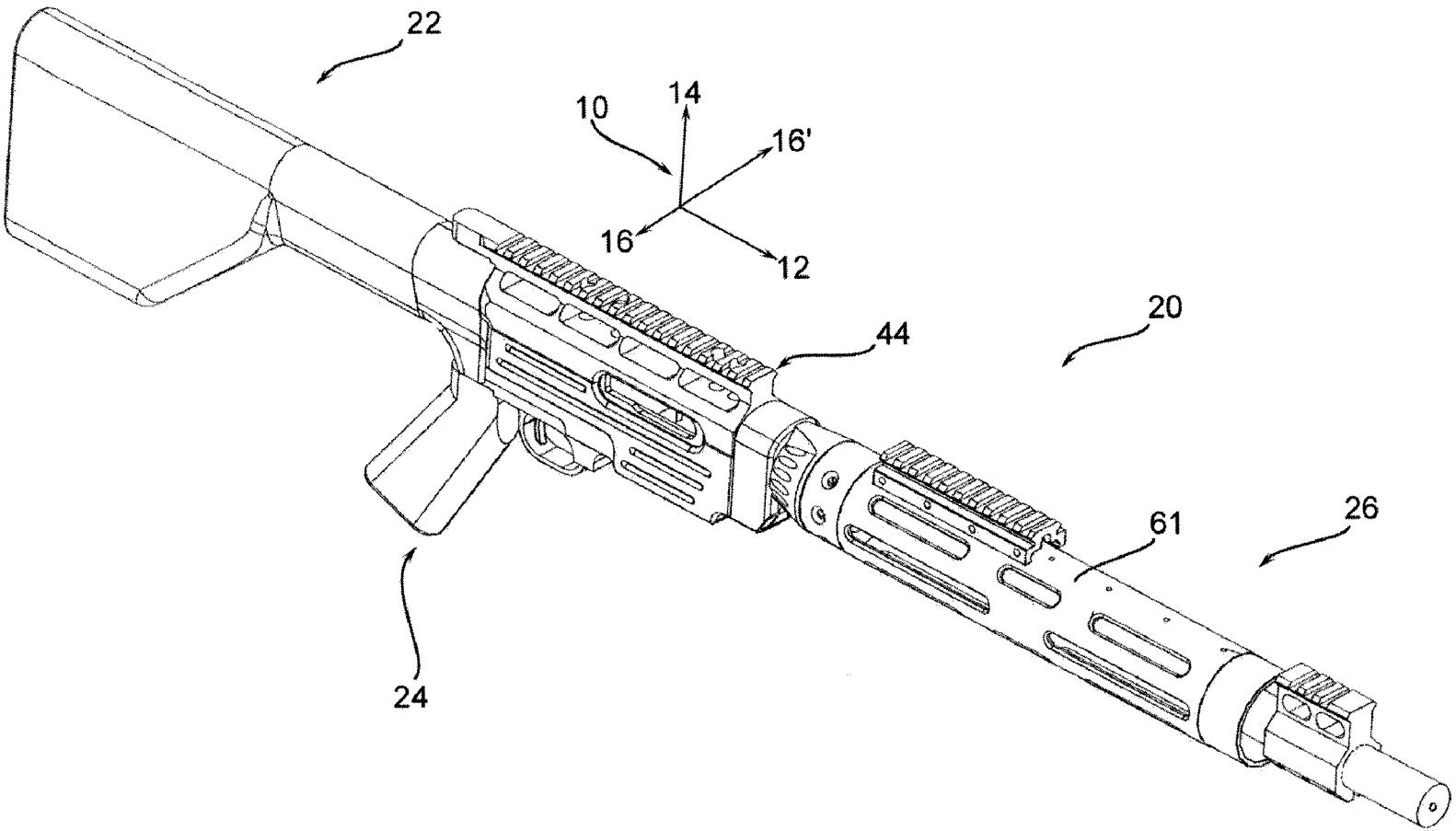
FIG. 1 shows an isometric view of a rifle system.
Figure 2:
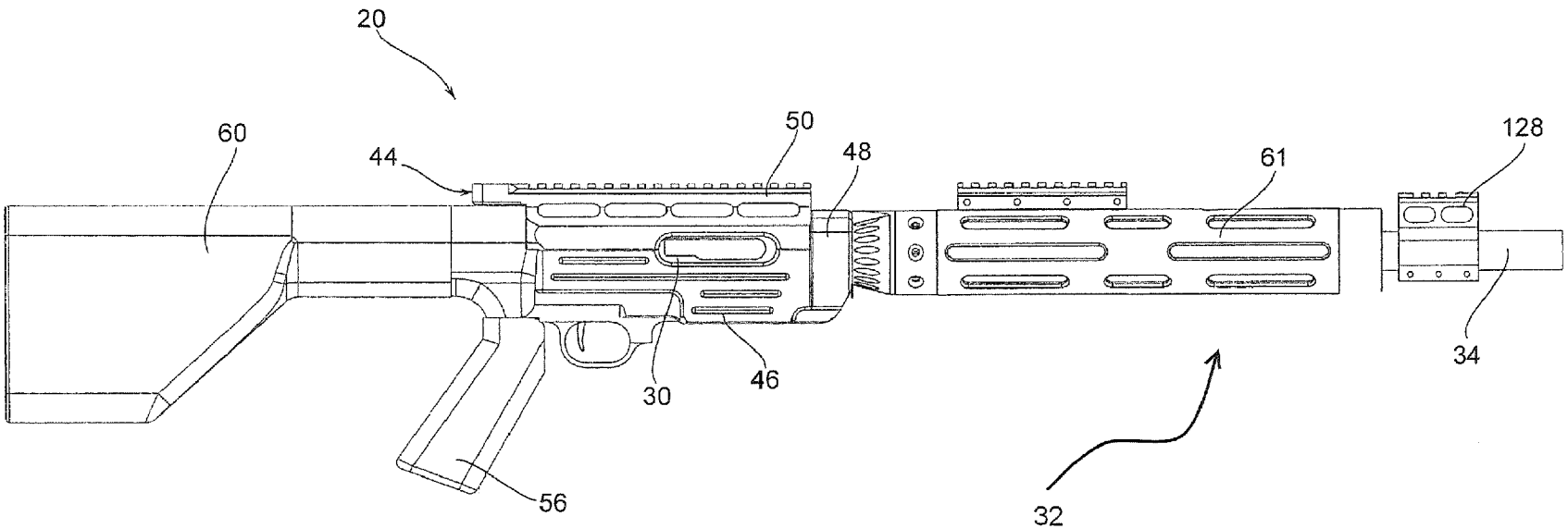
FIG. 2 shows a side view of a rifle system.

As shown in FIG. 1, there is a rifle system 20. In general, the rifle system can be generally broken down into a butt stock region 22, a pistol grip region 24 and a hand guard region 26. Before further description and still referring to FIG. 1, an axes system 10 is defined whereby and is provided to help explain the general relationship of components, but not necessarily limit such relationships or narrowly define the orientation of the rifle, and of course a vertical direction of the rifle could be positioned in any direction relative to the flux field of gravity. The axis 12 indicates the longitudinal axis pointing in a longitudinal forward direction. The axis 14 defines a vertical direction and substantially orthogonal to axes 12 and 14 is the lateral axis 16 pointing in a first direction, with the axis 16' hereby defined as a second lateral direction.

Figure 3:
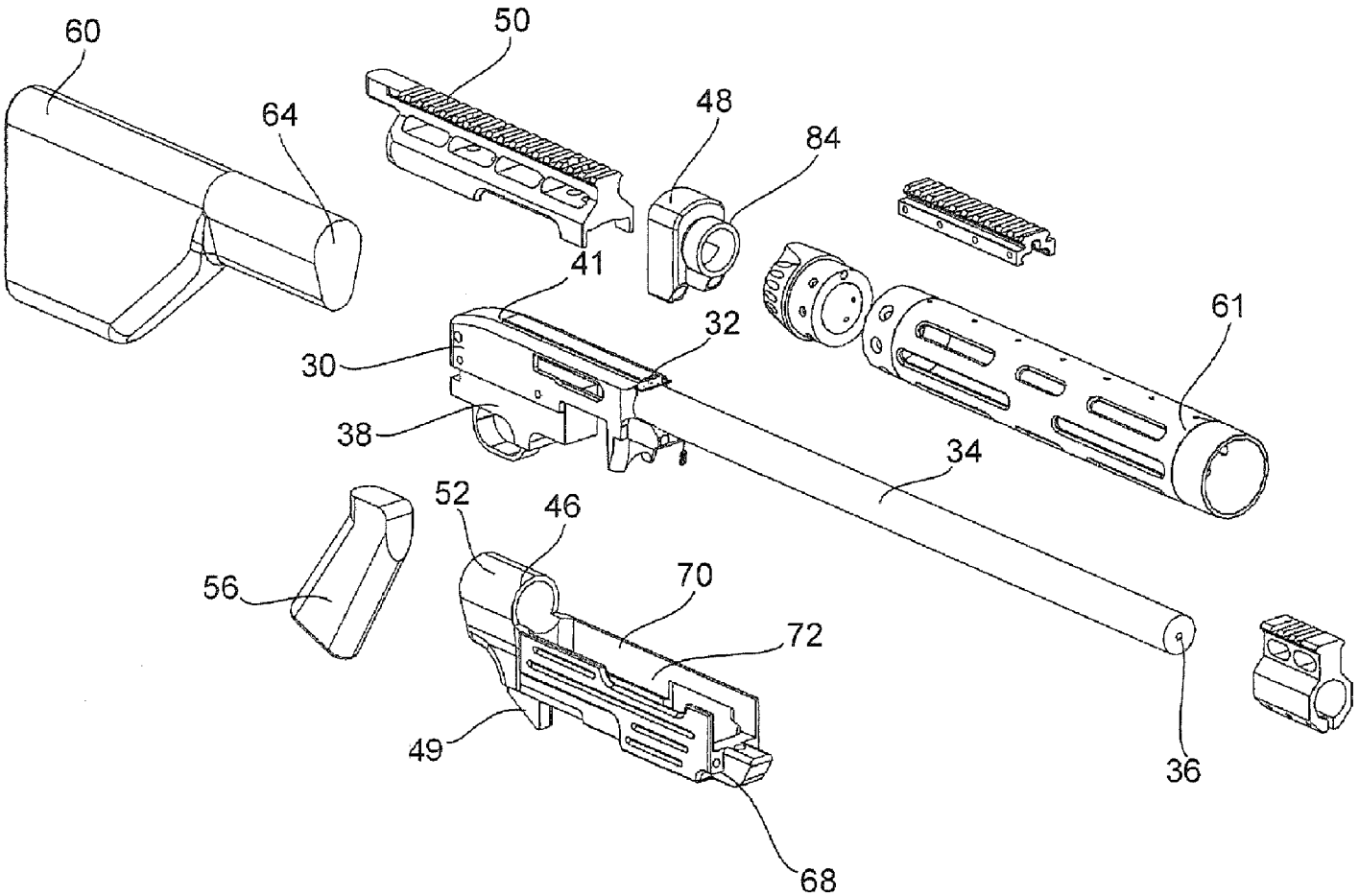
FIG. 3 shows an exploded view of a rifle system showing an interior action and barrel assembly having a rifle conversion platform assembly positioned therearound along with other rifle components such as a hand guard, pistol grip and butt stock.
Figure 6A:
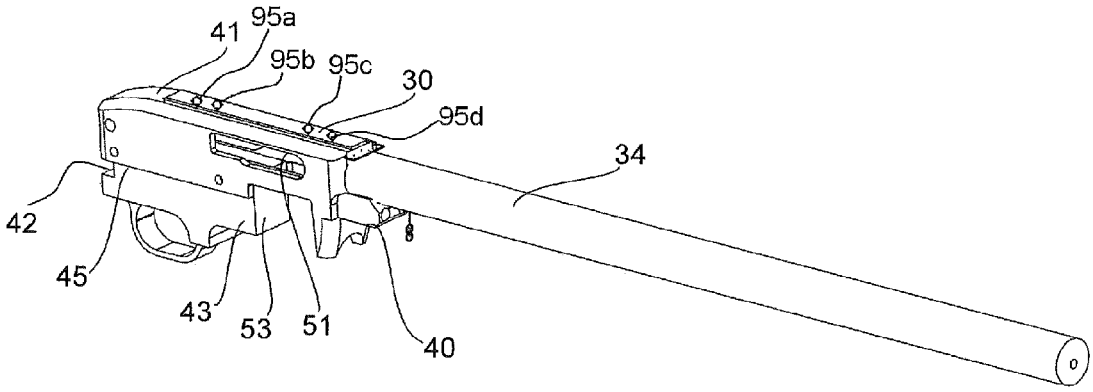
FIG. 6A PRIOR ART
FIG. 6A shows an isometric view of an action and barrel assembly which in one form can be a Ruger® 10-22 base platform.

Referring ahead now to FIG. 3 there is shown an exploded view of one embodiment of the present disclosure. Located in the central region of the exploded view of FIG. 3 there is an action 30. In one form the action is a Ruger® 10-22 action which as noted in the background is a popular platform provided by the Sturm, Ruger & Co, Inc., and of course there are many derivatives and third-party vendors providing components as well as custom actions based on this platform. Of course in the broader scope, other types of actions could be employed. Attached to the action at a forward location 32 is the barrel 34. In general, the barrel has a muzzle region 36. Further enclosed within the action 30 is a trigger assembly located at the region 38. In general, the action has various attachment locations where as shown in FIG. 6A, positioned at the regions 40 and 42 are first and second attachment locations whereby the action 30 is operatively configured to be attached to a stock. Oftentimes in practice a Ruger® 10-22 action may be purchased with a stock and the factory stock is removed and discarded. The description of the first and second attachment locations 40 and 42 will be further defined herein.

Figure 5:
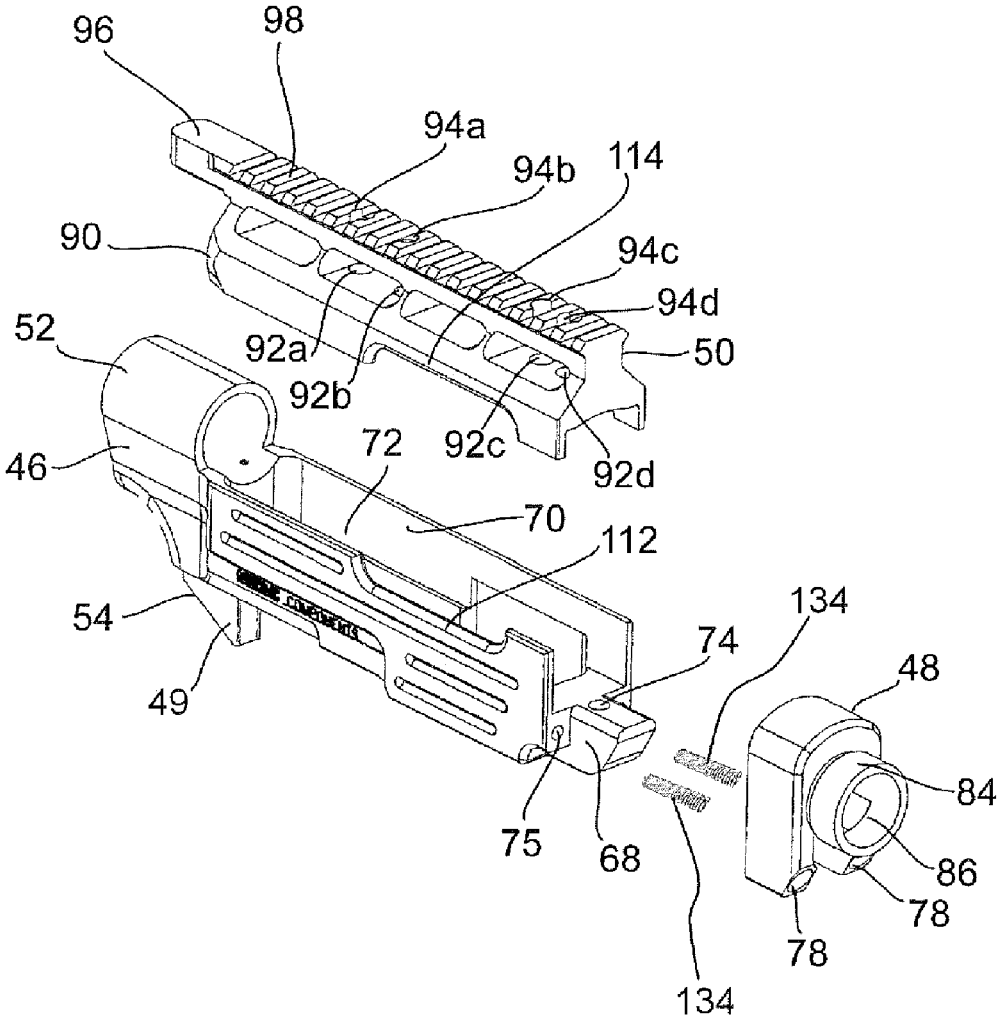
FIG. 5 shows an exploded view of the rifle conversion platform assembly, not including the various screws and set screws that are utilized therewith.

Referring back to FIG. 1, a complete rifle system 20 is shown. Positioned near the pistol grip region 24 is the rifle conversion platform assembly 44. As shown in FIG. 5, the rifle conversion platform assembly 44 generally comprises a main stock 46, a hand guard mount 48, and an optic mount 50.

Figure 4:
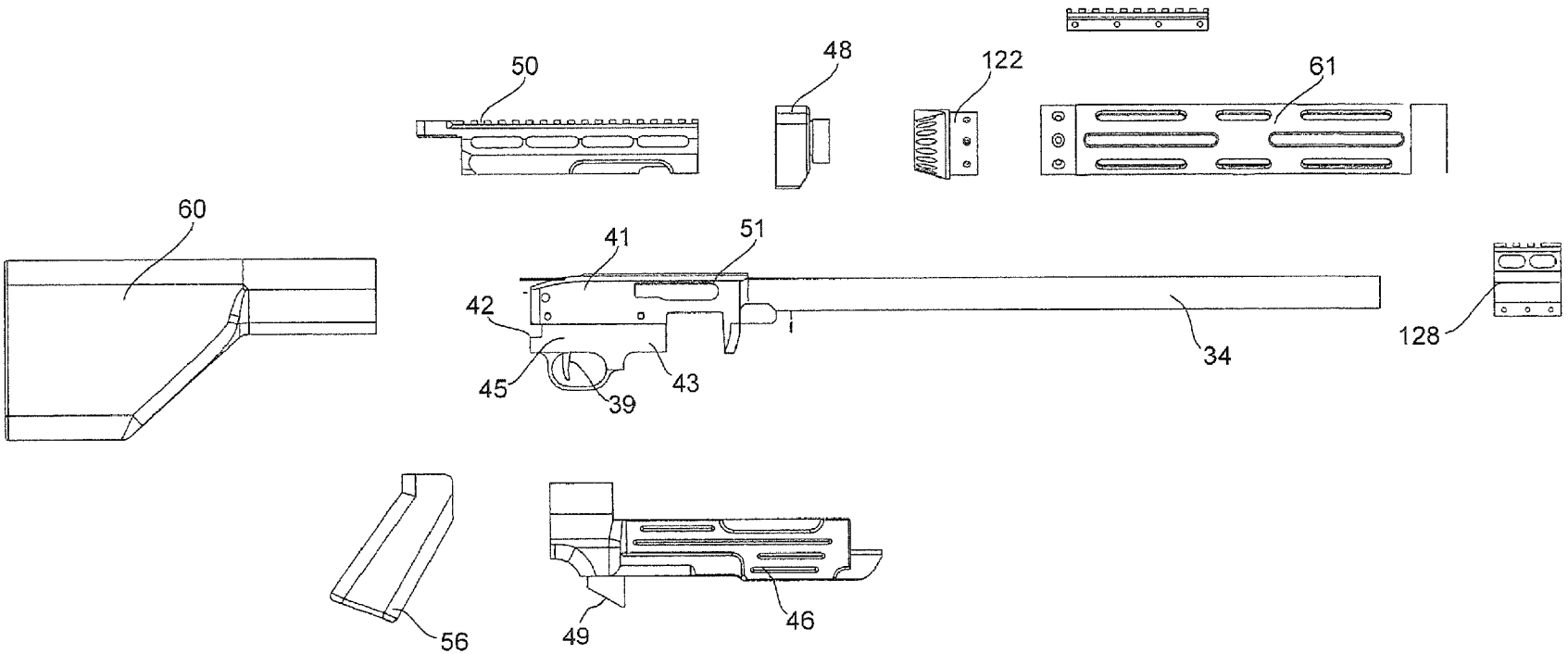
FIG. 4 shows a side exploded view of a rifle system where in the central portion thereof are positioned the three main components of the rifle conversion platform assembly which comprise the main stock, the optic mount and the hand guard mount.

The rifle conversion platform assembly 44 could, for example, be sold as a kit to individuals who own an existing action and barrel, such as the Ruger® 10-22 action. In general, the main stock 46 comprises a pistol grip mount region 50 and a butt stock mount region 52. The pistol grip mount region 50 is operatively configured to have the same profile as the rearward surface 54 having a threaded attachment member therein so as to fit a pistol grip 56 as shown in FIG. 4. In general, the location of the pistol grip mount region 50 is positioned in an ergonomic manner so as to have a similar dimension with respect to the trigger 39 as shown in FIG. 4. As described above, having a conversion platform so the user can use a cheaper rifle caliber and an action provided to work with such cheaper ammunition is desirable where the overall form and feel of the rifle assembly is that of a high-power rifle, in particular an AR-15 derivative. In a like manner, the main stock further has the butt stock mount region 52. As shown in FIG. 3, the butt stock 60 has an attachment location 64 which is standard in the industry and modular in nature. In a traditional AR-15, the butt stock 60 has a main spring and a plunger housed therein. The main spring is configured to absorb recoil from a bolt-and-carriage assembly within the upper receiver. However, for purposes of the rifle conversion platform kit, the main spring in one form is not employed. There are various types of attachment mechanisms, but as shown in FIG. 7B it can be seen how the butt stock mount region 52 comprises an upper threaded portion 66 and a lower recess which is common in the industry to fit an interface with the attachment locations 64 of the butt stock 60 (as shown in FIG. 3 where the butt stock is shown schematically without a male threaded engagement portion or a notch extension). Therefore, it can be appreciated that the pistol grip 56 and the butt stock 60 are configured to be positioned in a similar orientation with respect to the trigger 39 (see FIG. 4) to emulate the higher caliber rifle.

Figure 6B:
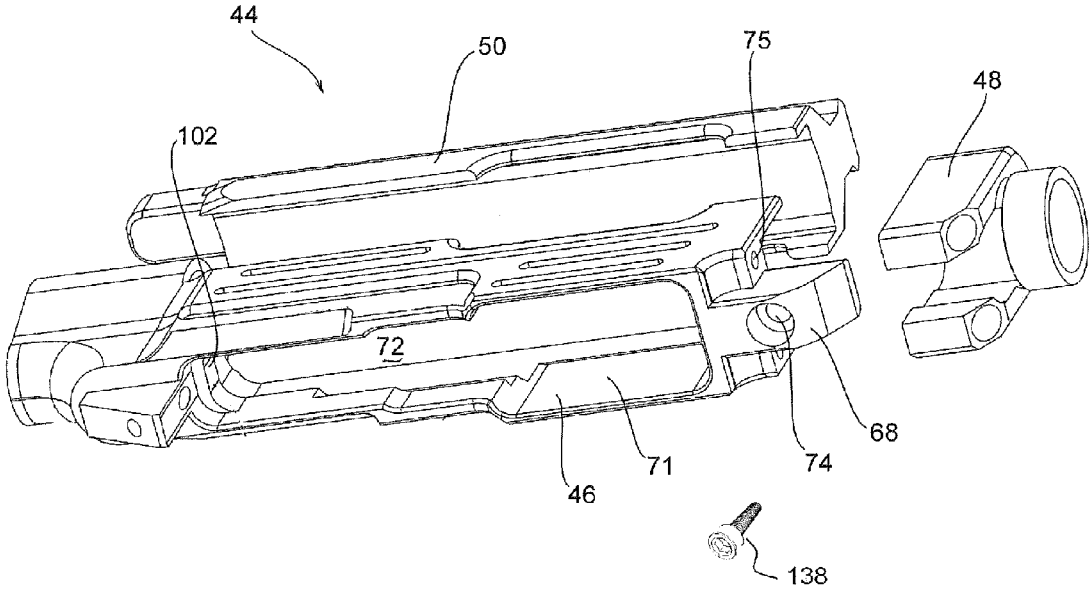
FIG. 6B shows a lower view of a the main stock.
Figure 7A:
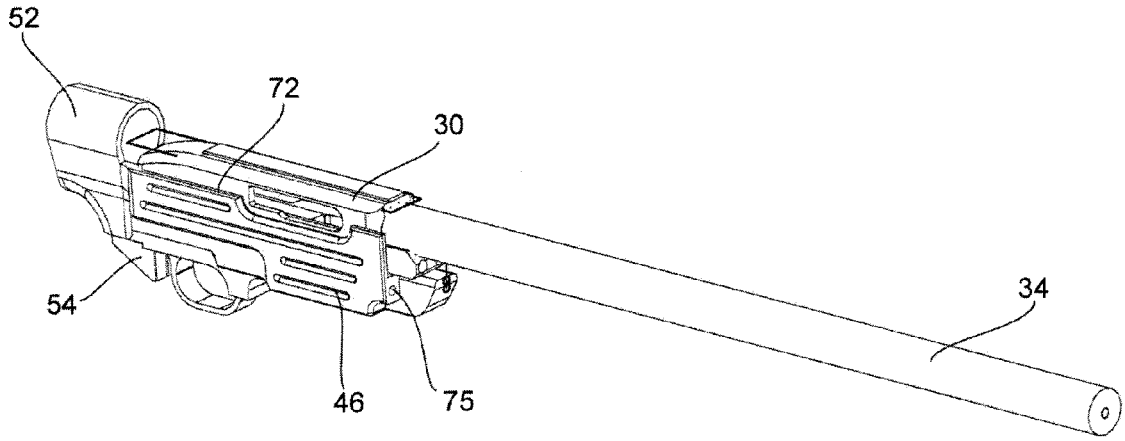
FIG. 7A shows the action with a main stock mounted thereto
Figure 7B:
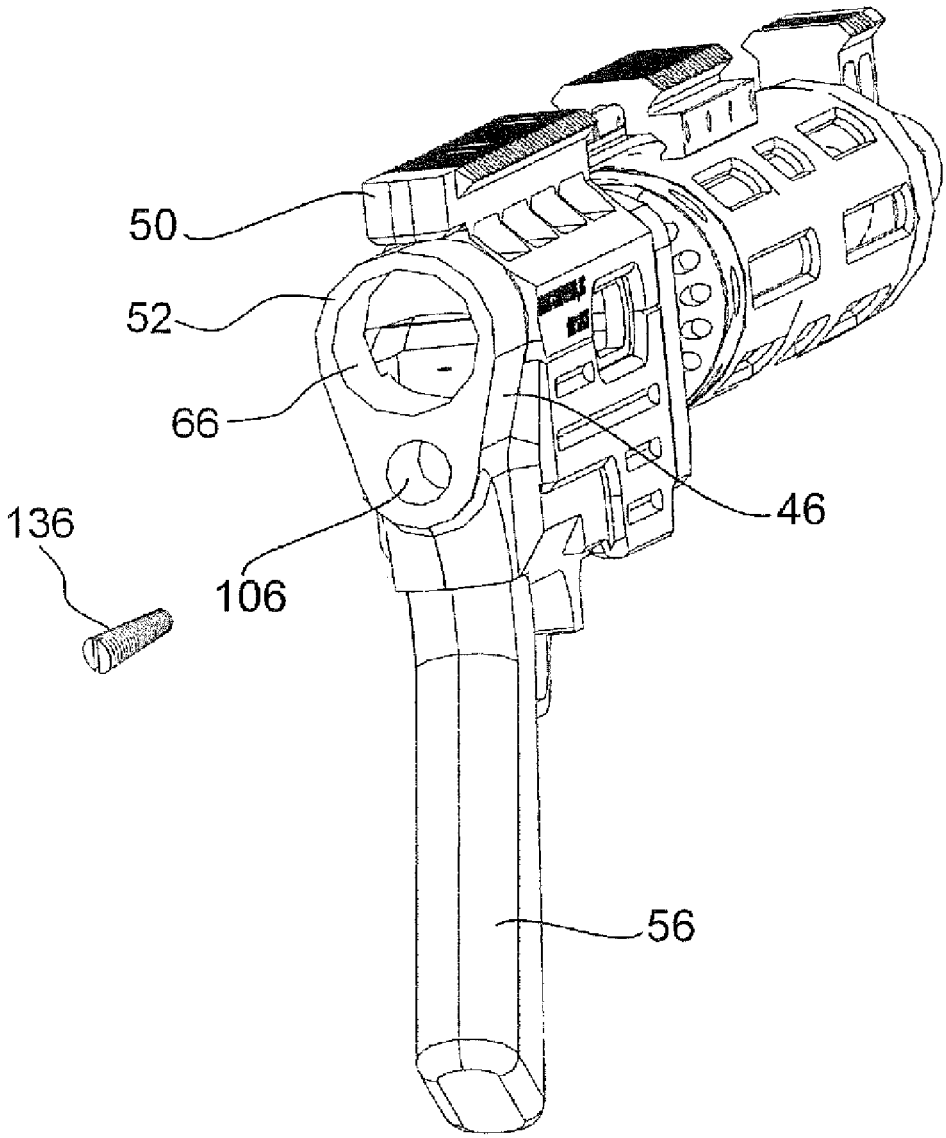
FIG. 7B shows a rearward view of the main stock.

As further shown in FIG. 5, there is an interior surface 70 which defines an action-receiving chamber 72 which is configured to have the action housed therein as shown in FIG. 7A. Further, there is a forward attachment location 68 having the threaded receiving locations 75 configured to have a bolt attached thereto. Of course, in other forms there could be other types of attachment mechanisms such as female and male threaded members. In general, as described below, the bolt is operatively configured to extend through the openings defining attachment locations 78 of the hand guard mount 48 to fixedly mount the hand guard 48 to the main stock 46. Further positioned in the longitudinal forward region of the main stock 46 near the forward attachment location 68 is a surface defining an opening defining a first action attachment location which corresponds in location to the first attachment location 40 of the action 30 as shown in FIG. 6A (as further shown in the lower view of FIG. 6B).

The action 30 as shown in FIG. 6A further comprises an upper region 41 and a lower region 43. Further contained within the action is a trigger assembly 45 which has an internal hammer, seer, disconnector and other common trigger components. Further, an ejection port 51 is provided with a bolt configured to be housed therein. Further, the region indicated at 53 is a magazine-receiving location where magazines with ammunitions contained therein are configured to be mounted thereto.

Referring now back to FIG. 5, there is shown the hand guard mount 48. In general, the hand guard mount 48 is operatively configured to be fixedly attached to the forward attachment location 68 of the main stock 46.

Figure 11:
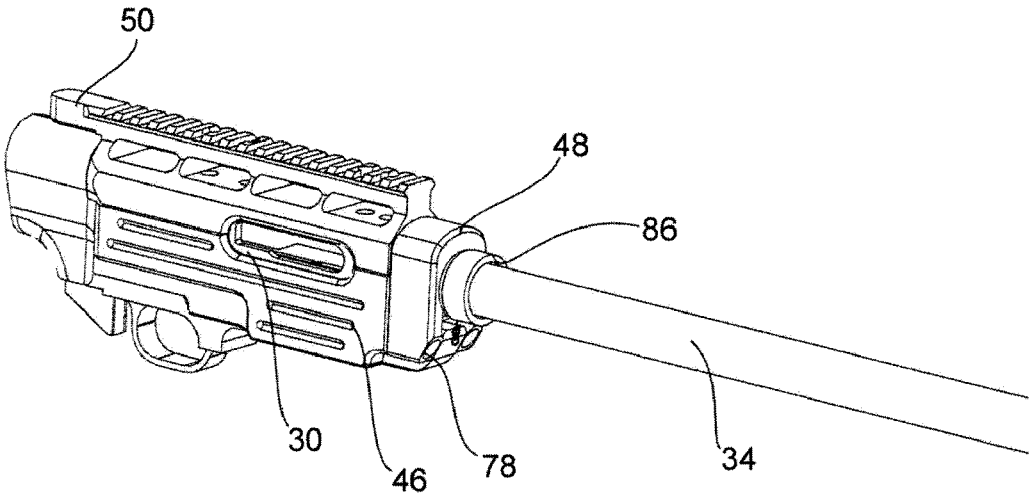
FIG. 11 shows the fore-grip mount rigidly mounted to the main stock.

It can be appreciated that the hand guard mount having the attachment locations 78 have a threaded member such as a hex bolt (not shown) that is configured to pass through to rigidly mount the hand guard mount to the main stock 46 in the manner described further below. It should he further noted that the hand guard mount has a hand guard interface region 84 which in one form is a threaded member having a similar dimension in one form to an upper receiver of an AR-15. By way of background, in general with an AR-15 platform this threaded portion is utilized and a barrel mount mounts the barrel rigidly to the upper receiver. The hand guard is mounted to this nut. However, to allow an interface with custom hand guards 61, the hand guard interface region is provided upon the hand guard mount 48. Further, the interior surface 86 defines a barrel passageway to allow the barrel 34 of the action 30 to extend therethrough (see FIG. 11).

Now referring back to FIG. 5, the final component of the rifle conversion platform assembly 44 is the optic mount 50. In general, the optic mount 50 has an action attachment location 90 which is configured to fit upon the upper region 41 of the action (see FIG. 3). As further shown in FIG. 5, there are a plurality of openings 92A-92D which are provided and correspond in location about their center axes to the upper openings 94A-94D. In general, it is common that the upper portion of an action has a plurality of threaded recess portions 95A-95D for mounting optics thereto, and other paraphernalia. Therefore, the openings 92 have an interior flange cylindrical portion to have force from a small screw member, specifically an hex screw, mounted thereto. The optic mount 50 further has an upper region 96 which in one form comprises a picatinny rail which is conventional and configured to have a plurality of types of optics such as scopes or iron sights mounted thereto. The piccatinny rail 98 began as a prescribed distance from the other components, namely, a pistol grip 56, hand guard 61 and the butt stock 60 to have a similar dimension and platform as an AR-15 in one form.

Figure 8:
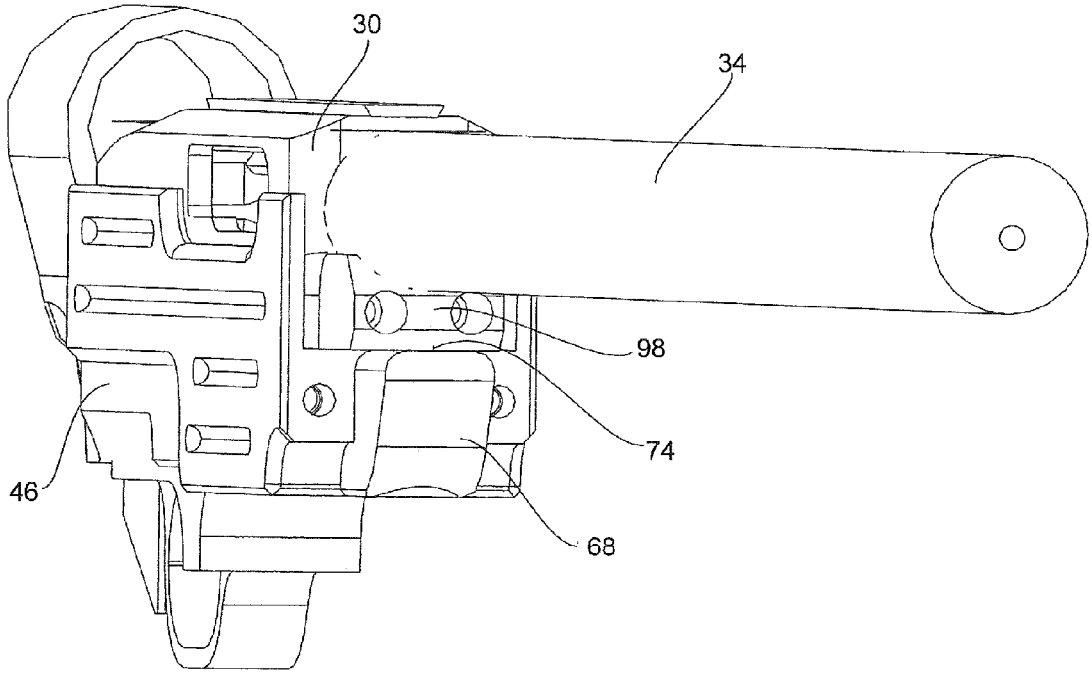
FIG. 8 shows a forward view of the main stock mounted to the action.

With the foregoing description in place, there will now be a detailed description of one form and method of converting an action 33 to a different platform. Initial reference is made to FIG. 6A which shows an action 30 having a barrel 34 attached thereto. What is shown in FIG. 6A can be conventionally found and what is schematically shown in FIG. 6A is the underlying platform of a Ruger® 10-22 or of course other base platforms could be employed in the broader scope. Referring now to FIG. 7A, it can be seen how the main stock 46 is positioned around the action 30. More specifically, the interior surface 70 which defines the action receiving chamber 72 (see FIG. 3) is positioned around the action 30. At this juncture it should be noted that as shown in FIG. 8, there is a view taken from a longitudinal forward vantage point where it can be appreciated that the barrel 34 is attached to the action 30 by way of a barrel attachment block 98. However positioned below the block 98 is a forward extension 100 which is a part of the main stock 46 and also forms therein the first action attachment location 74 which is best shown in FIG. 5. In general, a preferred form of mounting the main stock 46 is to first attach the main stock 46 to the second attachment location 42 (see FIG. 6A and more particularly FIG. 4) of the action 30. Normally, the ledge as shown in FIG. 6B is mounted to a stock and more particularly mounted to the interior extension 102 which operates as a second action attachment location as shown in FIG. 6A of the main stock 46. As further shown in FIG. 6B the lower portion of the action receiving chamber 72 is shown where in the forward portion a magazine receiving area 71 is provided.

Thereafter, the main stock 46 is rotated so the action fits within the action receiving chamber 72 (see FIG. 3) and thereafter a threaded nuts specifically passes through the first action attachment location 74 (see FIG. 5) and mounts the main stock 46 rigidly to the action 30 as shown in FIG. 7A. However, a preferred method of mounting the main stock 46 to the action 30 will now be described below.

Figure 9:
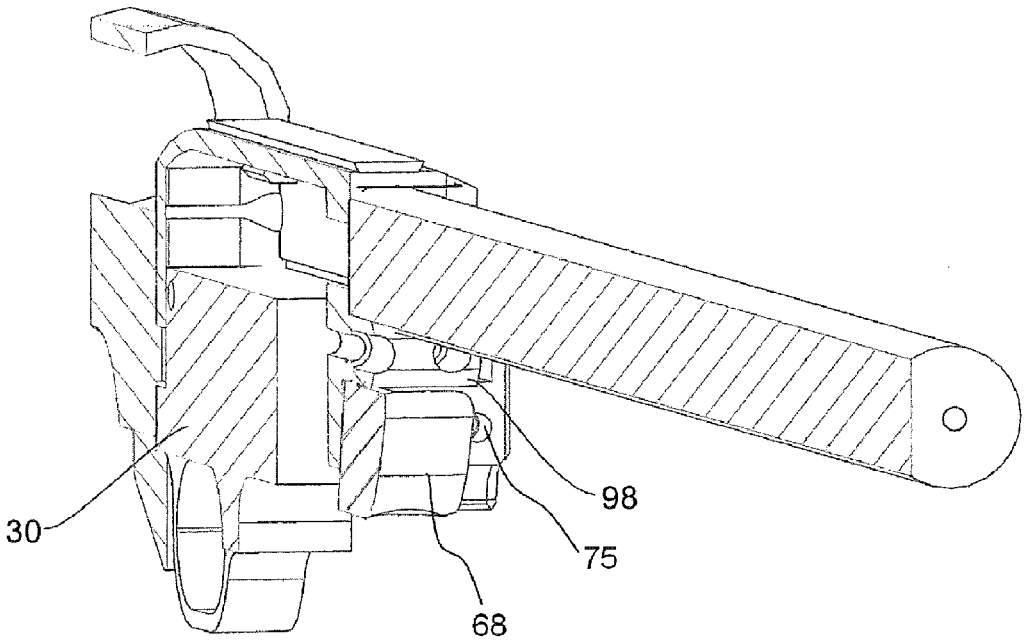
FIG. 9 is a partial section view of the action in the main stock taken along a plane perpendicular to the lateral axis.

In general, there are numerous models of Ruger® 10-22s in the marketplace. The dimensions of each model which extends back through decades, and further includes many aftermarket dealers making some of the components, provides a challenge to have a retrofit-type device to this particular action. Therefore, in order to position the action 30 with respect to the main stock 46, one technique is to utilize the threaded receiving locations 34 (see FIG. 7A) and place set screws 134 (see FIG. 5) therein so as to properly position the action in the action receiving chamber 72. Further, as shown in FIG. 7B there is a rear view of the main stock where it can be appreciated that recessed in the lower chamber 106 is a threaded portion adapted to receive a set screw 136 to provide a rearward longitudinal engagement with the action 30. Therefore, after the action is properly configured and placed within the main stock, a threaded member such as a hex screw 138 can thereafter pass through the first action attachment location 74 as shown in FIG. 6B. Referring to FIG. 9, there is shown a partial cross-sectional view where it can be seen that the action 30 is configured to be engaged through the threaded receiving locations 75.

Figure 10:
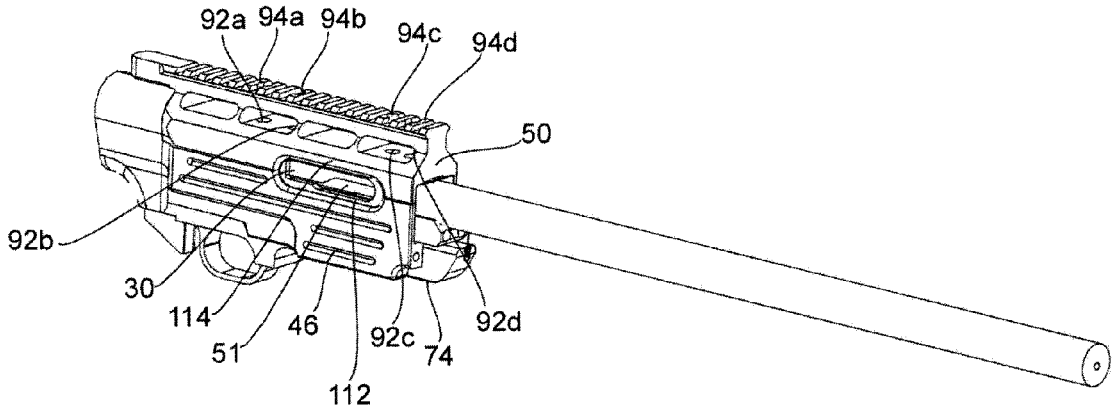
FIG. 10 shows an isometric view of the main stock and the optic mount mounted around the action with the action interposed therebetween.

Now referring to FIG. 10, there is shown the optic mount 50 which is now positioned on top of the action positioned therebelow. As described above, small threaded members such as hex screws can pass through the openings 94A-94D to the openings 92A-92D to rigidly mount the optic mount 50 to the action. It therefore can be appreciated that with the proper spacing of the main stock 46, the optic mount 50 would not directly touch the main stock 46 or at least significantly touch the main stock so as to have force applied to the optic mount. As described above, by utilizing the set screws to position the action with the main stock 46, it can be appreciated that the main stock 46 is only connected to the optic mount via the intermediate and interposed action. In one form, after the optic mount 50 is mounted, the installer will tighten and fasten the screw passing through the first action attachment location 74 of the main stock 46 so as to securely fasten the main stock to the action 30. As shown in FIG. 10, it can be appreciated that the surfaces defining the partial openings 112 and 114 are provided so as to allow access to the ejection port 51 of the action 30. Further, a charge handle attached to the bolt can extend therethrough. Now referring to FIG. 11, it can be seen that the hand guard mount 48 is attached to the main stock 46 by way of having screws pass through the attachment locations 78. In general, within the recess portion 78 is an annular flange to engage the head portion of the screw. It can be appreciated that the barrel passage 86 allows the barrel 34 to pass therethrough, and in a preferred form the forearm mount 48 simply passes down the end of the barrel and is thereafter mounted to the main stock 46.

Figure 12:
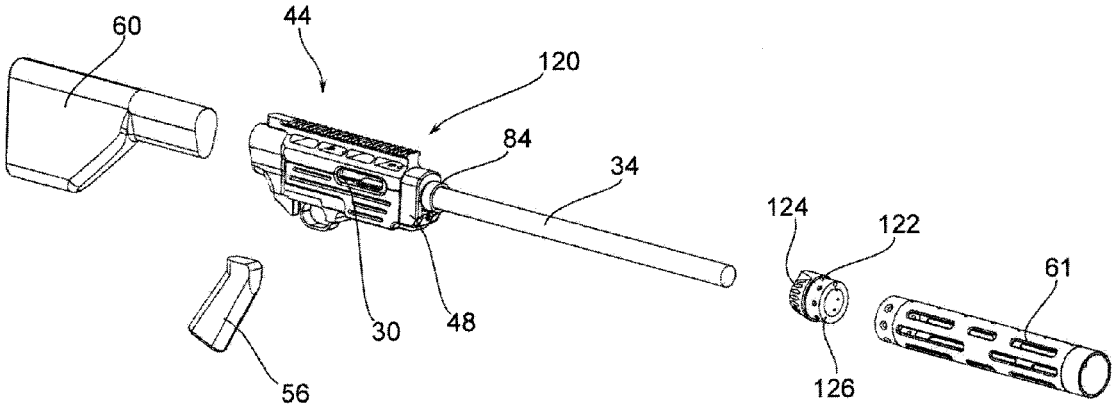
FIG. 12 shows an exploded view where the base assembly is shown in the central portion and a hand guard, barrel nut, pistol grip and butt stock are shown in an exploded view positioned around the base assembly.
Figure 13:
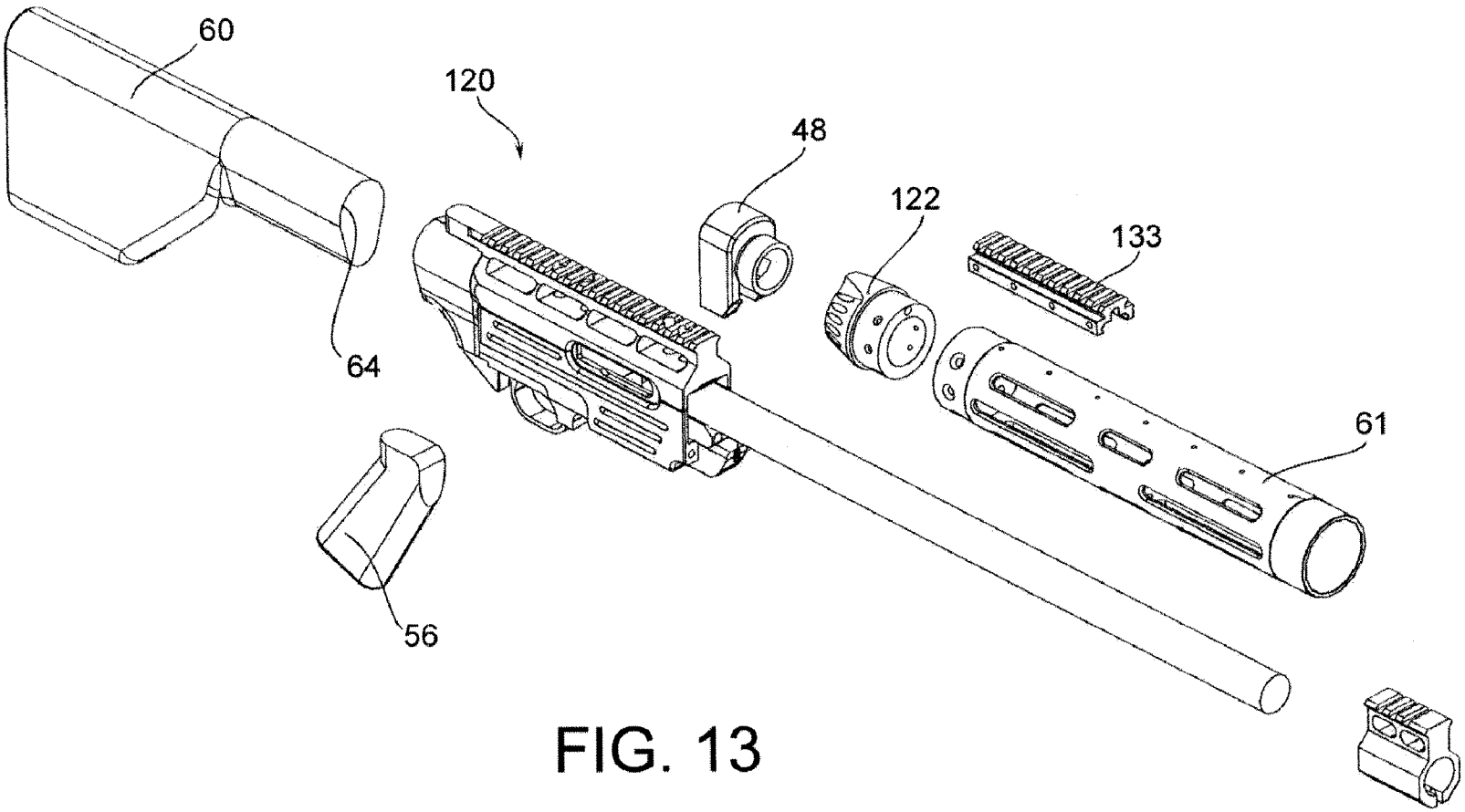
FIG. 13 shows the various attachments positioned around the base assembly.
Figure 14:
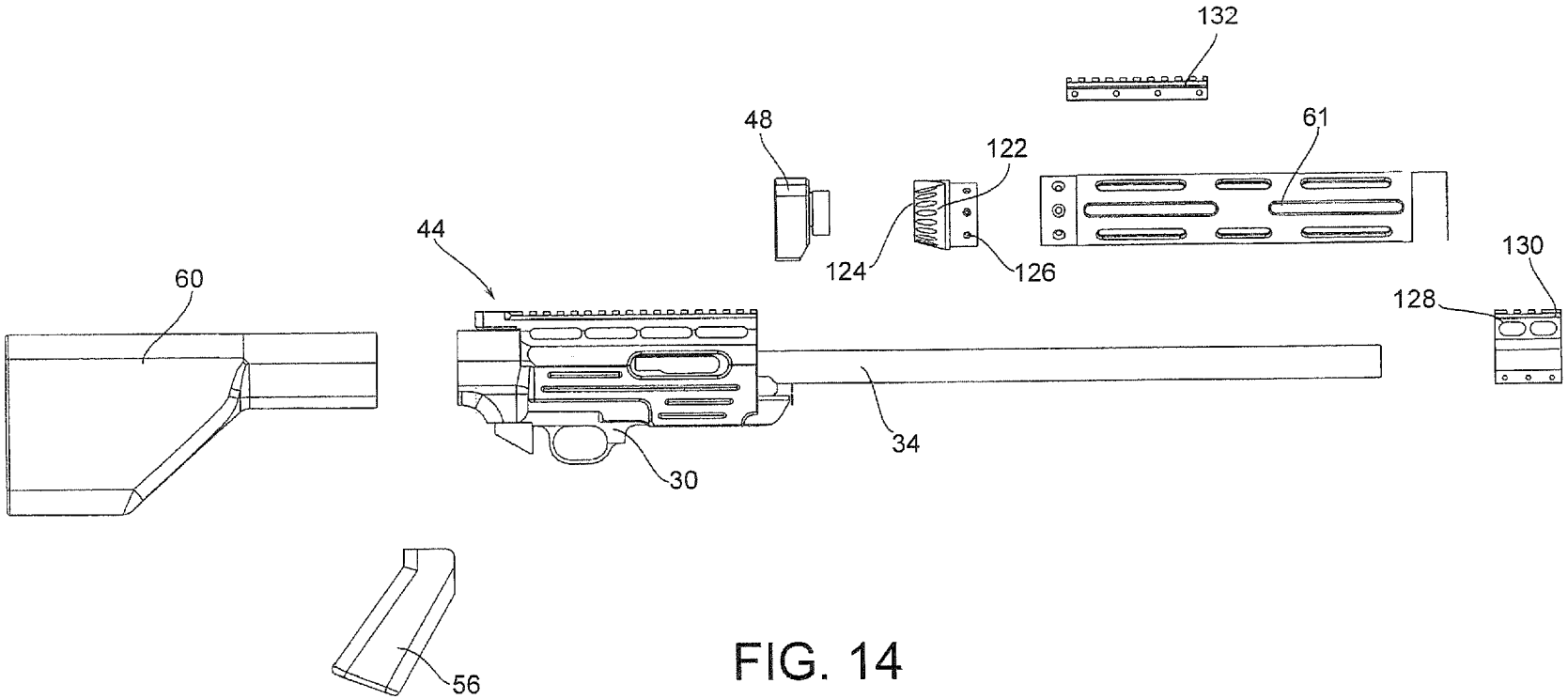
FIG. 14 is a side view of the isometric view shown in FIG. 13 where the hand guard mount is shown in a disengaged position from the main stock.

Now referring to FIG. 12, there is shown the base assembly 120 which in general comprises a rifle conversion platform assembly 44 (see the components as shown in FIG. 5) as well as the interior action 30 which is substantially encompassed by the rifle conversion platform assembly 44 and the barrel 34 is protruding longitudinally forward therefrom. As mentioned above, the hand guard mount 48 comprises the hand guard interface region 84, which emulates a barrel receiving location of for example an AR-15. Therefore, a barrel nut 122 having an interior threaded portion at the approximate location 124 can be threadedly engaged to the hand guard interface region 84. The barrel nut 122 in one form can have a hand guard interface 126 to have the hand guard 61 the rigidly mounted thereto. As shown in FIG. 14, an emulated gas block 128 can further be provided, which in one form may have an upper picatinny rail portion 130 which can be utilized to mount a front sight thereto. Still referring to FIG. 14, it can be appreciated that the hand guard can have, for example, attachments so a picatinny rail 132 can be mounted thereto, or other types of attachments such as a second optic or even a primary optic, sling mounds, bipod mounts, light rail mounts for various types of attachments including lasers, lights and other illuminating paraphernalia. In general, the platform is set up to allow the shooter to have any type of attachments which they would normally mount on their high caliber rifle.

With regard to a best mode of carrying out a method of converting an action and barrel assembly there will now be a detailed discussion of one way of such a converting. The first step is to retrieve the following components:

Main Stock Body
Scope Rail Shroud
Fore Arm Adapter
(1) ¼-28×1" SHCS—for hand grip
(1) #12-24×1" CS
(2) #10-32×0.87" SHCS
(4) #6-48×0.210 THCS
(2) #10-32 nylon set screw
(1) ¼-28 nylon set screw The assembly can be as follows. First removing the barreled action from the factory stock and if there is a factory sporter barrel, removing the rear sight from the barrel. Installing the ¼-28 nylon set screw into the rear of the main stock body and the (2) #10-32 nylon set screws into the front of the main stock body. These screws are designed to take up any play between the barrel action and AR22 main stock body.

Inserting the barreled action into the main stock body. In one form the installer will have to click the safety to the '½ way position' to clear the sides of the stock body. In one form the installer place the rear of the barreled action in to the rear of the main stock body, then rotate the rest of the receiver down into place. In one form the receiver can be bedded into the stock. The #12-24×1" CS will be used to secure the front end of the barreled action, but it should not be tighten at this phase. The installer then attachs the Scope Rail Shroud to the top of the barrel action, using the (4) #6-48×0.210 THCS. A threaded adhesive can be utilized. The installer can then mount and adjust the ¼-28 nylon set screw so that there is approx 0.010/0.020 gap between the back of the scope rail and main stock body. Thereafter the installer can tighten the (2) #10-32 set screws to keep the barreled action from moving back and forth with respect to the Main Body. The #12-24×1" CS are then tightened and the receiver should be locked in place. Finally the Fore Arm Adaptor is attached to the front of the main stock body using the remaining (2) #10-32×0.87 SHCS. Thereafter AR15 accessories at this time can be added at this time whereby typically following the instructions included with those parts. With regard to free float tubes, because the tube is notn holding a barrel in with the Tube's nut, there is no need to torque the nut on tightly. Instead, apply a thread locking compound such as a serviceable type and align the nut properly and let set up.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

We claim:

1. A housing assembly operatively configured to be fitted to an action where by the housing assembly is configured to have a butt stock, a pistol grip and a hand guard effectively mounted thereto, the housing assembly comprising:

a) a main stock having a pistol grip mount region and a butt stock mount region and the main stock operatively configured to be attached to the action, b) wherein the action comprises a threaded first attachment location near the longitudinal front of the action, and the action comprises a second attachment region near the longitudinal rear of the action, c) wherein the main stock comprises a first action attachment location which is aligned with the first attachment location of the action such that a threaded member passes through the first action attachment region of the main stock and threaded into the first attachment location of the action, d) wherein the main stock comprises a longitudinally projecting interior extension which fits within the second attachment region of the action to secure the longitudinally rearward portion of the action within the main stock, e) an optic mount configured to be attached to an upper portion of the action, f) a hand guard mount having an attachment portion which is operatively configured to be attached to the main stock, the hand guard mount further having a threaded hand guard interface region configured to have a female barrel nut threaded thereto, g) wherein the pistol grip mount region and the butt stock mount region of the main stock are configured to have the pistol grip and the butt stock mounted respectively thereto wherein force applied to the hand guard attached to the hand guard mount at the hand guard interface region and force applied to the pistol grip mounted to the pistol grip mount region is transferred to the main stock which in turn transfers force to the action, and h) the optic mount is operatively connected to the main stock by way of having the action interposed therebetween.

2. The housing assembly as recited in claim 1 where the main stock has an adjustment system comprising a plurality of threaded receiving locations; configured to be longitudinally adjusted with respect to the stock before being attached to the action.

3. The housing assembly as recited in claim 1 where the optic mount has a picatinny rail in the upper portion thereof.

4. The housing assembly as recited in claim 1 where the action is a 10-22 action.

5. The housing assembly as recited in claim 1 wherein the hand guard attached to the hand guard mount is a tubular hand guard.

6. A rifle comprising:

a) an action;

b) an optic mount comprising an upper ejection surface and a main stock comprising a lower ejection surface, the upper ejection surface and lower ejection surface overlay and provide unrestricted access to an ejection port of the action;

c) the action furthermore comprising a trigger assembly which in turn comprises a trigger, d) a barrel mounted to the action at a longitudinally forward location;

e) the main stock fixedly and removably attached to the action, the main stock having an interior surface defining an action-receiving chamber, the main stock further having a forward attachment location, a pistol grip mount region and a butt stock mount region, f) the optic mount attached to the upper region of the action, g) a hand guard mount attached to the forward attachment location of the main stock, the hand guard mount having a hand guard interface attached to a hand guard, h) a pistol grip attached to the main stock at the pistol grip mount region, and i) a butt stock attached to the butt stock mount region of the main stock; and j) where the hand guard interface is a threaded member and the hand guard comprises a female threaded barrel nut and a forward hand guard portion attached to the female threaded barrel nut.

7. The rifle as recited in claim 6 where the action is an action of a 10-22.

8. The rifle as recited in claim 7 where the hand guard interface is a male threaded member of the same outer diameter as the inner diameter of a barrel mount.

9. The rifle as recited in claim 7 where the main stock and the optic mount are fastened to one-another the action.

10. The rifle as recited in claim 9 where the main stock is configured to be first fixedly and removably attached to the action, and thereafter the hand guard mount having a surface defining a barrel passage is repositioned from a forward muzzle end of the barrel so as to have the barrel pass through the barrel passageway of the hand guard mount and the hand guard mount is thereby operatively configured to be attached to the forward attachment location of the main stock.

11. The rifle as recited in claim 10 where the hand guard mount is not directly attached to the optic mount.

12. The rifle as recited in claim 10 where the hand guard, pistol grip and butt stock are all attached to the main stock and the main stock is attached to the action whereby any force hand guard, pistol grip or butt stock is not directly transferred to the optic mount.

* * * * *